United States Patent [19]

Setsuie et al.

[11] Patent Number: 4,603,042

[45] Date of Patent: Jul. 29, 1986

[54] METHOD FOR MAKING CARBON FIBERS

[75] Inventors: Takashi Setsuie; Yuichi Fukui; Tadao Kobayashi, all of Ohtake, Japan

[73] Assignee: Mitsubishi Rayon Co., Ltd., Tokyo, Japan

[21] Appl. No.: 703,618

[22] Filed: Feb. 21, 1985

[30] Foreign Application Priority Data

Feb. 24, 1984 [JP] Japan ..... 59-34076

[51] Int. Cl.[4] ..... D01F 9/22

[52] U.S. Cl. ..... 423/447.4; 264/29.2; 423/447.1; 423/447.2; 423/447.6

[58] Field of Search ..... 423/447.4, 447.6, 447.1, 423/447.2; 264/29.2

[56] References Cited

U.S. PATENT DOCUMENTS 4,259,307 3/1981 Maryuma ..... 423/447.6

4,378,343 3/1983 Sugiura et al. ..... 423/447.6

*Primary Examiner*—John Doll

*Assistant Examiner*—Lori S. Freeman

*Attorney, Agent, or Firm*—Oblon, Fisher, Spivak, McClelland & Maier

[57] ABSTRACT

There is disclosed a method for making high strength carbon fibers which comprises carbonizing acrylic fibers applied with an aqueous dispersion of a silicone compound represented by the following general formula [I] dispersed with an emulsifier represented by the following general formula [II], the total amount of the silicone compound and the emulsifier being 0.01 to 10.0% by weight (owf) and the weight ratio of the emulsifier to the silicone compound being 0.05 to 0.4:

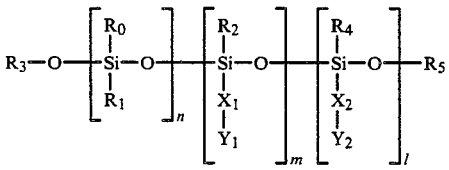

[I]

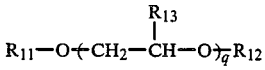

[II]

(where the symbols are as defined hereinbefore).

5 Claims, No Drawings

METHOD FOR MAKING CARBON FIBERS

BACKGROUND OF THE INVENTION

This invention relates to a method for producing high-quality carbon fibers rapidly and efficiently from acrylic fibers.

More particularly, it relates to a method for producing high strength carbon fibers without causing self adhesion or fusion bonding between them at a calcination step at high temperatures.

Many proposals have been made for making high-strength and high-elasticity carbon fibers on an industrial scale since it has been found that acrylic fibers are useful for the making of carbon fibers. Especially, when carbon fibers are used as reinforcing materials for composite materials, a high tensile strength is required and further, stable performance is desired not only as single filaments, but as fiber tows.

For satisfying these demands, it is necessary to carry out under optimum conditions the calcination process for converting the precursor acrylonitrile fiber tows to the desired carbon fiber tows, namely, the pre-oxidation step of treating the precursor acrylonitrile fibers at a temperature within the range of 200° to 300° C. in an oxygen containing gas stream, the pre-carbonizing step of treating the fibers at a temperature of 700° C. or less in an inert gas stream such as nitrogen gas or the like and the carbonizing step of treating the fibers at a temperature of 2000° C. or less in an inert gas stream such as nitrogen gas, argon gas or the like. At the same time, it is also an important task to find precursor fibers which can easily afford the desired performance of carbon fibers.

However, the calcination stage for conversion of acrylic fibers to carbon fibers causes large physical and chemical changes and the causal relations between the two are still not clear and there still many unsolved problems. Thus, it is necessary to investigate the conditions to be possessed by acrylic fibers for carbon fibers and the optimum calcination process from industrial aspects.

As a result of the inventor's intensive research on methods for rapid and efficient production of carbon fiber tows from acrylic fibers, it has been confirmed that in the calcination process the pre-oxidation step which is the first stage is very important. That is, this step has the role of allowing to proceed the cyclizing reaction and crosslinking reaction of molecules which constitute the acrylic fibers to provide firm intermolecular bonds and to modify the molecular structure to one which can easily proceed to carbonizing reaction.

Hitherto, the pre-oxidation step has been carried out by heat-treating the precursor fibers at a temperature of 200 to 300° C. in air, but requires a considerably long time to allow the reaction to proceed sufficiently. This is a big factor in the high price of carbon fibers.

The reactions at said pre-oxidation step, mainly cyclization reaction of nitrile group and oxidative crosslinking reaction caused by absorption of oxygen are greatly influenced by the heat-treating temperature and the progress of the reactions is accelerated with increase in the temperature. Therefore, when reduction of pre-oxidation time as much as possible and rapid calcination are aimed at, establishment of calcination techniques at higher temperatures is one of the most important task. For example, according to the inventors' research, when the pre-oxidation is carried out at 240° C. in an air stream, a calcination time of 1 to 3 hours is required while when it is carried out at 270° C., the calcination time can be reduced to 20 to 40 minutes. Density of fibers is gradually increased by the pre-oxidation and reaches about 1.35 to 1.40 g/cm$^3$ at optimum.

One of the most severe difficulties in reduction of pre-oxidation time by increase of pre-oxidation temperature is that this brings about much self adhesion or fusion bonding between filaments of the single fibers during the calcination process. This phenomenon is recognized to nearly always occur with normal acrylic fibers although differing in its degree depending on compositions of the starting fibers, surface structure and the number of constituting single filaments.

Furthermore, carbon fibers obtained by carbonizing the oxidized fibers where self adhesion or fusion phenomenon has occurred are much deteriorated in mechanical properties, especially tensile strength to often cause breakage during carbonizing step. This clearly shows that the self adhesion or fusion phenomenon has a very bad effect on the properties of produced carbon fibers.

For preventing the fusion phenomenon, it has been proposed, e.g., in Japanese Patent Laid-Open Application (Kokai) No. 117724/74, U.S. Pat. No. 4,009,248 and U.S. Pat. No. 4,378,343 to apply a silicone compound to the surface of acrylic fibers. For example, dimethylsilicone appliedacrylic fibers obtained by immersing acrylic fibers in a solution of dimethylsilicone in an organic solvent such as ethyl alcohol are excellent in fusion resistance. However, use of organic solvents as medium for the treatment is industrially very disadvantageous. For this reason, ordinarily the application of a siloxane or aminosiloxane compound to fibers is carried out by once emulsifying said compound with an emulsifier to obtain an aqueous emulsion of said compound and then treating the fibers with this aqueous emulsion.

However, the inventors have found that according to the above method, the fusion phenomenon may occur depending on the amount of the emulsifier which is applied to the fibers and this markedly deteriorates the properties of produced carbon fibers. This invention is based on research to overcome this defect.

SUMMARY OF THE INVENTION

The object of this invention is, therefore, to provide a method for producing carbon fibers free from said fusion phenomenon and this has been attained by subjecting the precursor acrylic fibers to a specific oiling agent treatment.

DESCRIPTION OF THE INVENTION

Thus, this invention resides in production of carbon fibers which comprises calcining acrylic fibers which have been allowed to contact with an aqueous dispersion obtained by dispersing a silicone compound represented by the following general formula [I] with an emulsifier represented by the following general formula [II] to carbonize or graphitize the acrylic fibers wherein the total amount of the silicone compound and the emulsifier which are applied to the acrylic fibers is 0.01 to 10.0% by weight (owf) and the weight ratio of the silicone compound and the emulsifier which are applied to the acrylic fibers, $$\left[\frac{\text{emulsifier}}{\text{silicone compound}}\right]$$

is 0.05 to 0.4:

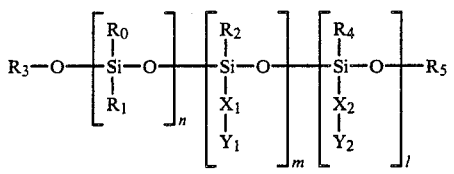

[I]

[wherein $R_0$, $R_1$, $R_2$ and $R_4$ are hydrogen, alkyl group or aryl group, $R_3$ and $R_5$ are hydrogen or

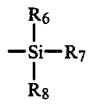

(wherein $R_6$, $R_7$ and $R_8$ are hydrogen, lower alkyl group or aryl group), $X_1$ and $X_2$ are alkylene group or arylene group, $Y_1$ and $Y_2$ are

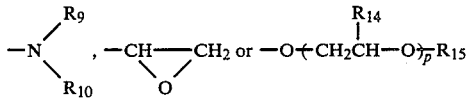

(wherein $R_9$ is hydrogen or a lower alkyl group, $R_{10}$ is hydrogen, a lower alkyl group or an aminoalkyl group, $R_{14}$ and $R_{15}$ are hydrogen or methyl group and p is an integer of 20 or less), and l, m and n are 0 or positive integers which provide a molecular weight of the silicone compound of 100,000 or less and

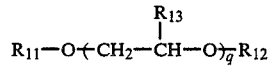

[II]

(wherein $R_{11}$ and $R_{12}$ are hydrogen, a branched alkyl, a branched alkyl substituted aryl, or phosphate group, one of $R_{11}$ and $R_{12}$ being a branched alkyl or a branched alkyl substituted aryl, $R_{13}$ is hydrogen or methyl group and q is an integer of 20 or less).

According to the inventors' research, it has been found that emulsifiers promote the fusion phenomenon. Thus, use of the emulsifiers in a large amount causes reduction of the effect of silicone compound to prevent the fusion phenomenon.

It is effective for decrease of the amount of emulsifier which is applied to acrylic fibers to reduce concentration of emulsifier in emulsions of silicone compound.

It is also possible to decrease the amount of the emulsifier which is applied to acrylic fibers by once applying the silicone compound and the emulsifier to the fibers and thereafter selectively extracting and removing the emulsifier.

The emulsifiers used in this invention are compounds represented by the general formula [II].

Polyethylene glycols and polypropylene glycols of the general formula [II] where both the groups $R_{11}$ and $R_{12}$ are hydrogen are not preferred because although these emulsifiers have a good emulsifying effect to emulsify polysiloxanes into aqueous media, the precursor acrylic fibers treated with these oiling agents have a high tendency of formation of tars and result in fusion or self adhesion between the fibers in a flame proofing step.

On the other hand, emulsifiers of branched alkyl ether type are excellent in homogeneous emulsifying of polysiloxane into aqueous medium and promoting uniform application of polysiloxane to the surface of fibers and besides can afford precursor acrylic fibers free from defects such as migration with time.

Emulsifiers where $R_{11}$ or $R_{12}$ is derived from a primary alcohol are not sufficient in dispersion power in an aqueous medium and emulsion stability of oiling agents obtained is low while an oiling agent prepared by emulsifying a polysiloxane in an aqueous medium with an emulsifier derived from branched alcohol has excellent emulsion stability. Emulsifiers derived from secondary alcohols exhibit especially excellent characteristics and are preferred.

The branched alcohols represented by $R_{11}$ or $R_{12}$ generally have 9 to 15 carbon atoms and when carbon number is less or more than said range the emulsifiability of polysiloxanes in aqueous media is liable to decrease.

In order to produce acrylic fiber precursor not susceptible to becoming tarred, it is preferred that the number of repeating units of alkylene glycol is 20 or less. Specific examples are ethylene oxide-added nonylphenyl ether, ethylene oxide-added alcohols, polyoxyethylene-added nonylphenyl phosphate, etc.

The especially preferred silicone compounds used in this invention are those represented by the general formula [I] wherein $Y_1$ or $Y_2$ is

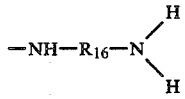

wherein $R_{16}$ is an alkylene group of 1 to 10 carbon atoms, especially 2 to 6 carbon atoms because dispersibility of these compounds in aqueous dispersion is stable.

The acrylic fibers used in this invention are those produced from polymers prepared by polymerization of at least 90 mol % of acrylonitrile.

In the case of such fibers as produced from polymers containing 10 mol % or more of components other than acrylonitrile, it is generally difficult to prevent self adhesion phenomenon in a flameproofing step and calcination operability is deteriorated and properties of the objective carbon fibers are much deteriorated.

As examples of other comonomers than acrylonitrile, mention may be made of acrylic acid derivatives such as acrylic acid, methacrylic acid, itaconic acid, methyl acrylate, methyl methacrylate, etc., acrylamide derivatives such as acrylamide, methacrylamide, N-methylolacrylamide, N,N-dimethylacrylamide, etc., alkylvinyl ketones such as methylvinyl ketone, ethylvinyl ketone, etc., acrolein derivatives such as acrolein, methacrolein, etc., vinylpyridine derivatives such as 2-vinylpyridine, 2-methyl-5-vinylpyridine, etc., sulfonic acid derivatives such as sodium methallylsulfonate, sodium styrenesulfonate, etc., vinyl acetate, methacrylonitrile, hydroxyethylacrylonitrile, etc. These may be used alone or in combination.

Said acrylonitrile copolymers may be produced by known polymerization processes, for example, solution polymerization in dimethylformamide, aqueous suspension polymerization and emulsion polymerization, using common radical polymerization catalysts, e.g., azo compounds such as azobisisobutyronitrile, etc., peroxides such as benzoyl peroxide, lauroyl peroxide, etc., redox catalysts such as potassium persulfate/sodium hydrogen sulfite, ammonium persulfate/sodium hydrogen sulfite, etc.

Spinning solutions are usually subjected to wet-spinning or dry-wet spinning using a coagulation bath of solvent-water system.

Filaments which have left the coagulation bath are subjected to main steps such as washing, stretching, drying for densification, furthermore, if necessary, post-stretching, relaxation, etc. to obtain acrylic fibers. Especially, it is necessary to attain a high orientation of the precursor fibers by the stretching step.

In order to produce precursor fibers of this invention, an emulsion prepared by emulsifying and dispersing a silicone compound with an emulsifier is applied to the spun and washed filaments in a water-swollen state (namely, before dry-densification) or the dry-densified filaments.

In this case, the total amount of the silicone compound and the emulsifier applied to the filaments is 0.01 to 10.0% by weight of the filaments and the weight ratio of the emulsifier to the silicone compound (emulsifier/silicone compound) is 0.05–0.4.

When the total amount of the applied silicone compound and emulsifier is less than 0.01% by weight, it does not exhibit fusion preventing effect and when more than 10.0% by weight there occurs much entanglement of fibers around rollers or guides due to adhesion of the silicone compound, which conspicuously deteriorates workability during spinning.

When the weight ratio of emulsifier/silicone compound exceeds 0.4 the fusion phenomenon becomes conspicuous and the object of this invention cannot be attained and when it is less than 0.05 the silicone compound is not sufficiently emulsified and dispersed and uniform application of the compound to the fibers is difficult.

Thus obtained precursor acrylic fibers are then transferred to the usual calcination step. Firstly, the fibers are subjected to pre-oxidation treatment at a temperature of 200° to 330° C. in an oxygen-containing gas stream under a constant tension, then pre-carbonization at a temperature of 700° C. or less in an inert gas stream and subsequent carbonization treatment at a temperature of about 1500° C. or less in a highly pure inert gas stream. If necessary, thus treated fibers are further subjected to graphitization treatment at a temperature of 3000° C. or less.

In carbonization treatment of the modified acrylic fibers of this invention there occurs substantially no self adhesion or fusion between single fibers even in such pre-oxidation treatment as of, for example, at 270° C. for about 30 minutes or 300° C. for about 10 minutes which is a short time treatment much severe than when conventional precursor fibers are used. Thus, soft flameproofed fibers are obtained and carbon fibers produced by calcining the flameproofed fibers have much superior mechanical properties.

As explained hereinbefore, according to this invention, it becomes possible to produce high performance carbon fibers by applying a silicone compound and an emulsifier as specified in this invention to acrylic fibers for carbon fibers during production of the acrylic fibers and rapidly calcining thus treated fibers as precursor at a relatively high temperature. Thus, this invention has a high industrial value.

This invention is further illustrated in the following Examples.

Properties of strands of the carbon fibers are expressed by a mean value obtained by measurement on 10 specimens of 200 mm in accordance with JIS R-7601.

EXAMPLE 1

A spinning solution of 24% by weight was prepared by dissolving in dimethylformamide an acrylonitrile copolymer prepared by aqueous suspension polymerization method and comprising 98% by weight of acrylonitrile and 2% by weight of methacrylic acid and having a specific viscosity of 0.21 (measured at 25° C. by dissolving 0.1 g of the polymer in 100 ml of dimethylformamide).

This spinning solution was spun by a dry-wet spinning method through a spinning nozzle having 2000 holes of 0.15 mm in diameter and then washed and stretched to obtain water-swollen acrylic fibers having a moisture content of 120%.

Then, said water-swollen fibers were treated with an emulsion bath prepared by emulsifying the aminosiloxane represented by the following formula (1) in water with an ethylene oxide-added alcohol represented by the following formula (2) thereby to apply the emulsion to the fibers. Subsequently, the fibers were subjected to drying and densification to obtain acrylic fibers (a), (b), (c), (d) and (e) having a denier of 1.3 with various application amounts of the emulsion.

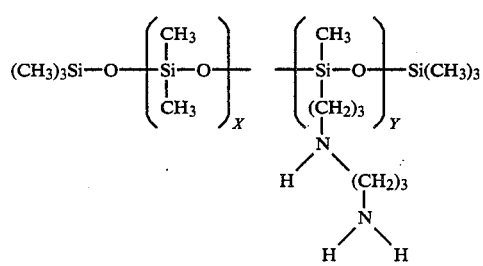

(1)

Molecular weight is 15000 and N content was 0.7%.]

$$C_nH_{2n+1}O—(CH_2CH_2O)_mH \quad (2)$$

[This compound is a mixture of various compounds, $C_nH_{2n+1}O$— means a secondary alcohol, n is 12 as a mean value and m is 7 as a mean value.]

Amounts of the silicone compound and the emulsifier which were applied to thus treated acrylic fibers are shown in Table 1.

Then, these fibers (a), (b), (c), (d) and (e) were subjected to flameproofing treatment at a temperature of 220° C. to 260° C. for 40 minutes in air and thereafter subjected to carbonizing treatment by subjecting to a temperature increasing gradient of 500 to 1200° C. in $N_2$ to obtain carbon fibers (A), (B), (C), (D) and (E).

Properties of strands of these carbon fibers are shown in Table 1.

It was recognized from these experimental results that when the weight ratio of the emulsifier and the silicone compound which were applied to the acrylic fibers was more than 0.4, the strength of the carbon fibers made from these acrylic fibers decreased due to fusion phenomenon.

TABLE 1

| Acrylic fibers No. | Silicone compound No. | Amount of applied silicone compound (wt % owf) | Emulsifier No. | Amount of applied emulsifier (wt % owf) | Emulsifier / Silicone compound Weight ratio | Carbon fibers No. | Property of carbon fibers: Strength (kg/mm²) | Property of carbon fibers: Variability of strength CV % |
|---|---|---|---|---|---|---|---|---|
| a | (1) | 0.90 | (2) | 0.13 | 0.14 | A | 441 | 3 |
| b | (1) | 0.91 | (2) | 0.25 | 0.27 | B | 435 | 2 |
| c | (1) | 0.90 | (2) | 0.36 | 0.40 | C | 428 | 4 |
| d (comparative) | (1) | 0.67 | (2) | 0.59 | 0.67 | D (comparative) | 385 | 8 |
| e (comparative) | (1) | 0.76 | (2) | 0.68 | 0.76 | E (comparative) | 332 | 11 |

EXAMPLE 2

An acrylonitrile polymer prepared by an aqueous suspension polymerization method and comprising 95% by weight of acrylonitrile, 4% by weight of methyl acrylate and 1% by weight of methacrylic acid and having a specific viscosity of 0.220 (measured at 25° C. by dissolving 0.1 g of the polymer in 100 ml of DMF containing 0.1 mol of sodium thiocyanate) was dissolved in dimethylacetamide to prepare a spinning solution of 24% by weight in concentration. This spinning solution was wet spun through a spinning nozzle having 6000 holes of 0.06 mm in diameter using a 67 wt % aqueous dimethylacetamide solution as a coagulation bath kept at 40° C. and taken up at a rate of 5 m/min to obtain unstretched filaments. The unstretched filaments were stretched 5.5 times their length with washing in hot water of 98° C. and then further sufficiently washed in a boiling water to obtain water-swollen acrylic fibers having a moisture content of 150%.

Then, a silicone compound and an emulsifier were applied to said water-swollen fibers in the same manner as in Example 1 except that ethylene oxide-added nonylphenyl ether represented by the following formula (3) was used as the emulsifier to obtain acrylic fibers (f), (g), (h) and (i) as shown in Table 2.

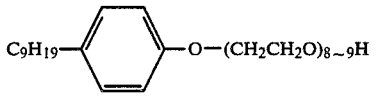

(3)

Then, these acrylic fibers were carbonized in the same manner as in Example 1 except that the flame-proofing time was 60 minutes to obtain carbon fibers (F), (G), (H), and (I).

It was also recognized from the results that high performance carbon fibers were obtained from acrylic fibers where the application weight ratio of emulsifier/silicone compound was 0.4 or less.

TABLE 2

| Acrylic fibers No. | Silicone compound No. | Amount of applied silicone compound (wt % owf) | Emulsifier No. | Amount of applied emulsifier (wt % owf) | Emulsifier / Silicone compound Weight ratio | Carbon fibers No. | Property of carbon fibers: Strength (kg/mm²) | Property of carbon fibers: Variability of strength CV % |
|---|---|---|---|---|---|---|---|---|
| f | (1) | 1.3 | (3) | 0.26 | 0.20 | F | 411 | 4 |
| g | (1) | 1.2 | (3) | 0.42 | 0.35 | G | 403 | 3 |
| h (comparative) | (1) | 1.4 | (3) | 0.67 | 0.48 | H (comparative) | 386 | 10 |
| i (comparative) | (1) | 1.2 | (3) | 0.74 | 0.62 | I (comparative) | 350 | 12 |

EXAMPLE 3

To the water-swollen acrylic fibers obtained in the same manner as in Example 1 were applied dimethylsilicone represented by the following formula (4) together with the emulsifier (2) to obtain acrylic fibers (j), (k), (l) and (m) as shown in Table 3.

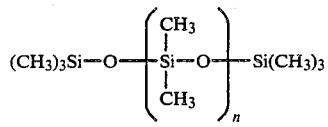

(4)

[molecular weight: 10000]

These fibers were calcined in the same manner as in Example 1 to obtain carbon fibers (J), (K), (L) and (M).

Properties of the strands of these carbon fibers is shown in Table 3. It was confirmed that high performance carbon fibers were obtained according to this invention.

TABLE 3

| Acrylic fibers No. | Silicone compound No. | Amount of applied silicone compound (wt % owf) | Emulsifier No. | Amount of applied emulsifier (wt % owf) | Emulsifier / Silicone compound Weight ratio | Carbon fibers No. | Property of carbon fibers: Strength (kg/mm²) | Property of carbon fibers: Variability of strength CV % |
|---|---|---|---|---|---|---|---|---|
| j | (4) | 0.40 | (2) | 0.10 | 0.26 | J | 396 | 3 |
| k | (4) | 0.50 | (2) | 0.20 | 0.40 | K | 387 | 4 |

TABLE 3-continued

| Acrylic fibers No. | Silicone compound No. | Amount of applied silicone compound (wt % owf) | Emulsifier No. | Amount of applied emulsifier (wt % owf) | Emulsifier / Silicone compound Weight ratio | Carbon fibers No. | Property of carbon fibers Strength (kg/mm$^2$) | Variability of strength CV % |
|---|---|---|---|---|---|---|---|---|
| l (comparative) | (4) | 0.50 | (2) | 0.25 | 0.50 | L (comparative) | 364 | 11 |
| m (comparative) | (4) | 0.42 | (2) | 0.25 | 0.60 | M (comparative) | 339 | 13 |

EXAMPLE 4

A silicone compound of the following formula (5) and the following emulsifier (6) were applied to water-swollen acrylic fibers obtained in the same manner as in Example 2 to obtain acrylic fibers (n), (o), (p) and (q) as shown in Table 4.

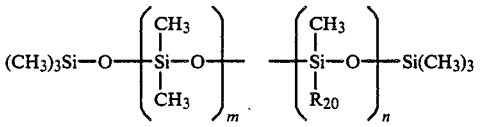

(5)

[molecular weight is 15,000, $R_{20}$ is

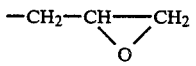

and said epoxy group is contained in an amount of about 1% by weight.]

Polyoxyethylene (9 units) nonylphenyl phosphate , (6)

These fibers were calcined in the same manner as in Example 2 to obtain carbon fibers (N), (O), (P) and (Q).

Properties of these carbon fibers are shown in Table 4.

It was confirmed that amount of emulsifier which adhered to the acrylic fibers had great effect on the properties of the carbon fibers.

TABLE 4

| Acrylic fibers No. | Silicone compound No. | Amount of applied silicone compound (wt % owf) | Emulsifier No. | Amount of applied emulsifier (wt % owf) | Emulsifier / Silicone compound Weight ratio | Carbon fibers No. | Property of carbon fibers Strength (kg/mm$^2$) | Variability of strength CV % |
|---|---|---|---|---|---|---|---|---|
| n | (5) | 2.3 | (6) | 0.23 | 0.10 | N | 397 | 4 |
| o | (5) | 2.5 | (6) | 0.91 | 0.37 | O | 382 | 4 |
| p (comparative) | (5) | 2.6 | (6) | 1.38 | 0.53 | P (comparative) | 342 | 10 |
| q (comparative) | (5) | 2.3 | (6) | 1.59 | 0.69 | Q (comparative) | 304 | 15 |

EXAMPLE 5

The acrylic fibers (e) obtained in Example 1 were treated with hot water of 90° C. with changing the treating time to obtain acrylic fibers (r), (s), (t) and (u).

These acrylic fibers were carbonized in the same manner as in Example 1 to obtain carbon fibers (R), (S), (T) and (U), properties of which are shown in Table 5.

From this experiment it was recognized that when the emulsifier was selectively removed by the post-treatment to reduce the ratio of emulsifier/silicone compound to 0.4 or less, performance of the carbon fibers obtained was increased.

TABLE 5

| Acrylic fibers No. | Amount of applied amino-siloxane (wt % owf) | Amount of applied emulsifier (wt % owf) | Emulsifier / Silicone compound Weight ratio | Carbon fiber No. | Property of carbon fibers Strength (kg/mm$^2$) | Variability of strength CV % |
|---|---|---|---|---|---|---|
| r (comparative) | 0.71 | 0.41 | 0.57 | R (comparative) | 371 | 9 |
| s | 0.69 | 0.25 | 0.36 | S | 435 | 4 |
| t | 0.72 | 0.10 | 0.14 | T | 451 | 3 |
| u | 0.65 | 0.05 | 0.08 | U | 462 | 3 |

EXAMPLE 6

The silicone compound of the following formula (7) together with the emulsifier (2) were applied to the water-swollen acrylic fibers obtained in the same manner as in Example 1 to obtain acrylic fibers (v), (w) and (x) as shown in Table 6.

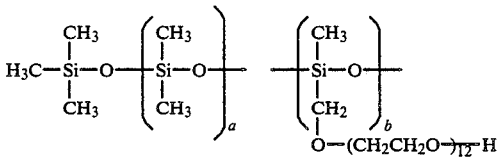

(7)

-continued

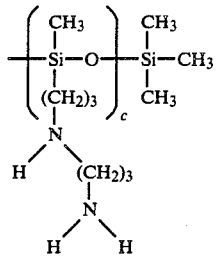

[Molecular weight is 16000, molecular weight of ethylene oxide-added silicone chain is 1000 and N content is 0.7% by weight.]

These fibers were calcined in the same manner as in Example 1 to obtain carbon fibers (V), (W) and (X).

Properties of the strands of these carbon fibers are shown in Table 6.

It was also found that when the silcone compound was a terpolymer, property of the carbon fibers was superior with decrease in the amount of the emulsifier.

TABLE 6

| Acrylic fibers No. | Silicone compound No. | Amount of applied silicone compound (wt % owf) | Emulsifier No. | Amount of applied emulsifier (wt % owf) | Emulsifier Silicone Weight ratio | Carbon fibers No. | Property of carbon fibers Strength (kg/mm²) | Variability of strength CV % |
|---|---|---|---|---|---|---|---|---|
| v | (7) | 1.13 | (2) | 0.11 | 0.097 | V | 451 | 4 |
| w | (7) | 1.21 | (2) | 0.20 | 0.16 | W | 437 | 4 |
| x (comparative) | (7) | 1.18 | (2) | 0.55 | 0.47 | X (comparative) | 378 | 8 |

What is claimed is:

1. A method for producing carbon fibers, which comprises:

contacting acrylic fibers with an aqueous dispersion of a silicon compound of the formula (I):

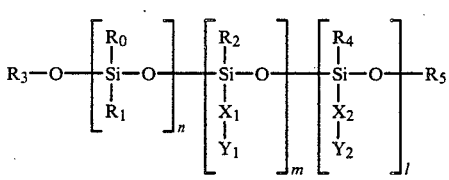

[I]

wherein each of $R_0$, $R_1$, $R_2$ and $R_4$ represents hydrogen, an alkyl group or an aryl group; each of $R_3$ and $R_5$ represents hydrogen or

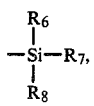

wherein each of $R_6$, $R_7$ and $R_8$ represents hydrogen, a lower alkyl group or an aryl group; each of $X_1$ and $X_2$ represents an alkylene group or an arylene group; each of $Y_1$ and $Y_2$ represents

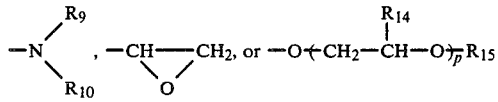

wherein $R_9$ represents hydrogen or a loweralkyl group, $R_{10}$ represents hydrogen or a lower alkyl group or an aminoalkyl group and each of $R_{14}$ and $R_{15}$ represents hydrogen or methyl; and each of l, m and n represents 0 or a positive integer, thereby providing a silicone compound having a molecular weight of no more than 100,000 and $l+m+n \geqq 10$, dispersed in an aqueous medium with an emulsifier of the formula:

$$C_nH_{2n+1}O-(CH_2CH_2O)_mH$$

wherein $C_nH_{2n+1}O-$ is the fragment of a secondary alcohol, n is a mean value of 12 and m is a mean value of 7, the total amounts of the silicone compound and the emulsifier which are applied to the acrylic fibers being 0.01 to 10.0% by weight (owf) and the weight ratio of the emulsifier to the silicone compound applied to the acrylic fibers being within the range of 0.05 to 0.4; and calcining the treated acrylic fibers in order to carbonize or graphitize the fibers.

2. The method of claim 1, wherein groups $Y_1$ and $Y_2$ of said silicone compound are aminoalkyl groups.

3. The method of claim 1, wherein groups $Y_1$ and $Y_2$ of said silicon compound have the formula:

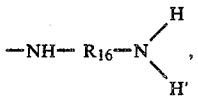

wherein $R_{16}$ is an alkylene group of 1 to 10 carbon atoms.

4. The method of claim 1, wherein said acrylic fibers are comprised of acrylonitrile polymer which contains at least 90 mole percent of acrylonitrile.

5. The method of claim 1, wherein said calcination step is constituted of several steps comprising:

pre-oxidizing said treated fibers;

pre-carbonizing said pre-oxidized fibers; and carbonizing said pre-carbonized acrylic fibers.

* * * * *